United States Patent [19]

Moraca

[11] Patent Number: 4,749,165

[45] Date of Patent: Jun. 7, 1988

[54] SUPPORTING DEVICE FOR MULTI-FLOOR COLUMN FORMS

[76] Inventor: Thomas Moraca, 2100 McMullen Rd., Largo, Fla. 33541

[21] Appl. No.: 36,417

[22] Filed: Apr. 9, 1987

[51] Int. Cl.[4] ..... E04G 13/02

[52] U.S. Cl. ..... 249/48; 249/51; 249/219.1

[58] Field of Search ..... 249/17, 48, 51, 143, 249/170–171, 173, 219 R, 164, 167; 24/285; 248/56; 285/373, 419; 403/336, 344

[56] References Cited

U.S. PATENT DOCUMENTS

| | | | |
|---|---|---|---|
| 713,537 | 11/1902 | Treadwell | 248/56 |
| 975,135 | 11/1910 | Kelsey et al. | 249/51 |
| 982,769 | 1/1911 | Eberle | 249/48 |
| 1,250,956 | 12/1917 | Bratter | 249/48 |
| 1,315,550 | 9/1919 | Ham | 285/419 |
| 2,975,498 | 3/1961 | Plattner | 249/219 R |
| 4,047,356 | 9/1977 | DePirro | 249/51 |

FOREIGN PATENT DOCUMENTS

| | | | |
|---|---|---|---|
| 899188 | 6/1962 | United Kingdom | 249/48 |

*Primary Examiner*—Jay H. Woo
*Assistant Examiner*—James C. Housel
*Attorney, Agent, or Firm*—Herbert W. Larson; Joseph C. Mason, Jr.

[57] ABSTRACT

A pair of semi-circular collar plates readily assembled and disassembled around a column form. The collar plates have an upright flange along an inner edge that is juxtaposed to the column form and a pair of outwardly projecting locking fixtures held together by a slotted key for easy removal.

6 Claims, 2 Drawing Sheets

SUPPORTING DEVICE FOR MULTI-FLOOR COLUMN FORMS

BACKGROUND OF THE INVENTION

1. Technical Field

This invention relates to a support for floor column forms. More particularly, it refers to a clamping device for holding column forms in place while pouring concrete.

2. Description of the Prior Art

The construction industry commonly employs labor intensive wood bracing to support a column form until the column concrete hardens sufficiently to support a next floor layer concrete pad. Many man hours are wasted in erecting and disassembling this wood bracing. Alternatively complicated column molds such as shown in U.S. Pat. No. 2,975,498 are used to support concrete columns until the concrete hardens. A simple support device is needed that can be readily assembled and disassembled employing a minimum of man hours.

SUMMARY OF THE INVENTION

I have invented a clamping device that can be used to support a column form. The device is simple to use and eliminates the need for elaborate wood bracing of column forms.

My device employs a pair of matching planar collar plates having a semi-circular configuration so that when matched together the plates form a circle around the column form at its base and at its top. The plates each have an upright flange along an inner edge of the plate and outwardly projecting integral locking fixtures at each end of the flange with the locking fixture at right angles to the plate. A slotted locking key fits into slots at the end of the locking fixture to hold the two plates in place. One pair of locking fixtures can be hinged for convenience in keeping the pair of plates together.

BRIEF DESCRIPTION OF THE DRAWINGS

The present invention may be best understood by those having ordinary skill in the art of constructing floor supporting columns by reference to the following detailed description when considered in conjunction with the accompanying drawings in which.

DETAILED DESCRIPTION OF THE PREFERRED EMBODIMENT

Figure 1:
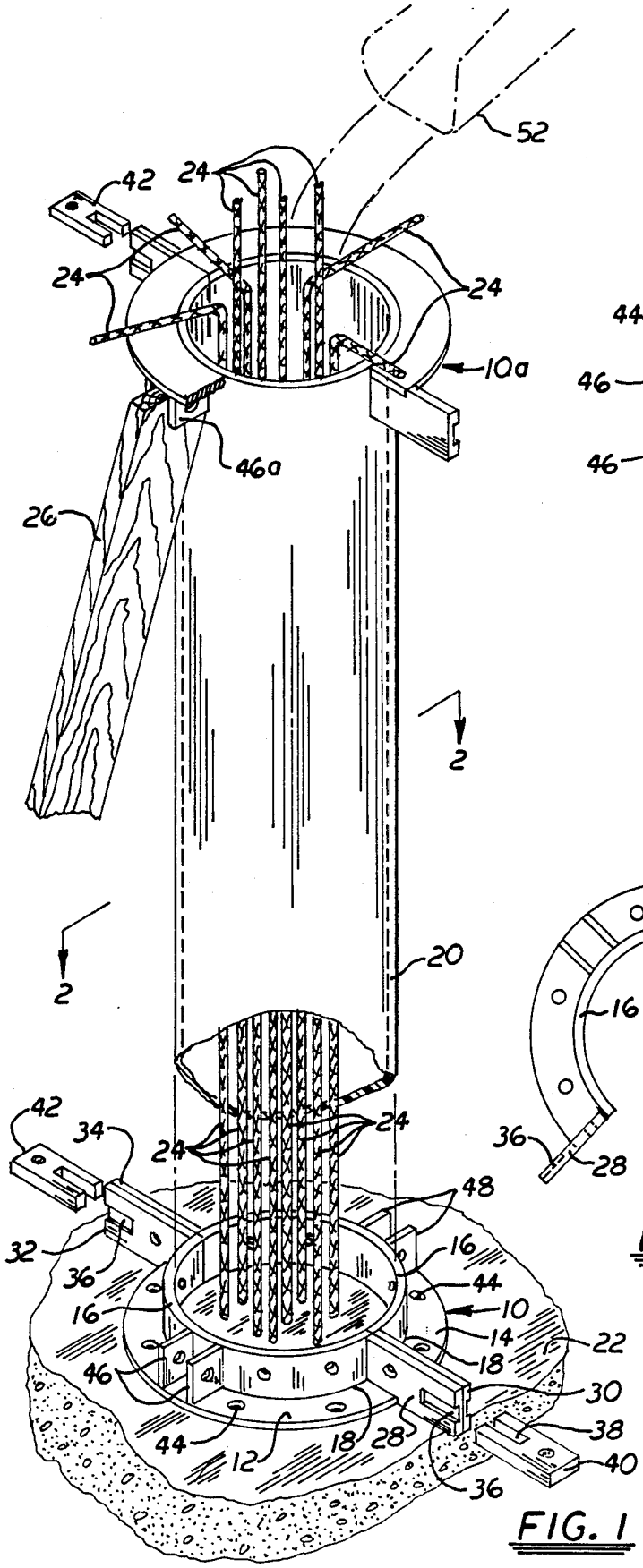
FIG. 1 is a perspective view of the supporting device of the invention with braces surrounding a partially cut away column form.
Figure 2:
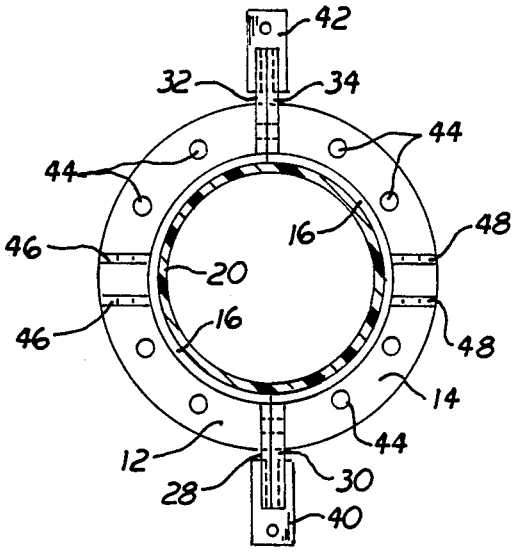
FIG. 2 is a top section view of the supporting device through line 2—2 of FIG. 1 showing the device in a locked mode.
Figure 3:
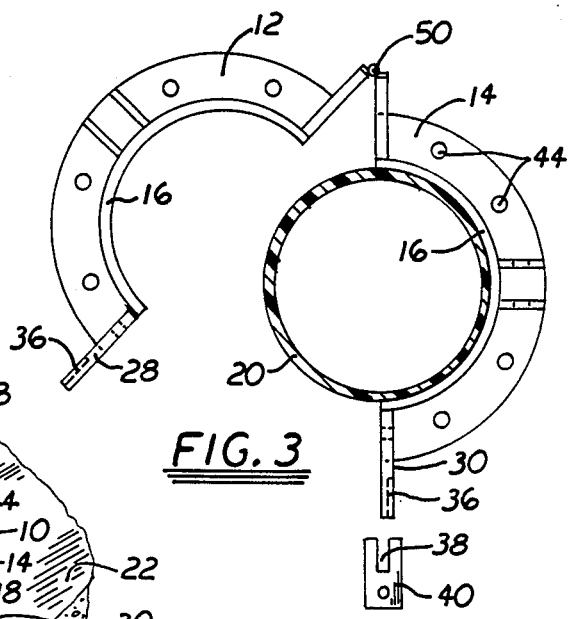
FIG. 3 is a plan view of the supporting device hinged in an open position around a column form.

Throughout the following detailed description the same reference numerals refer to the same elements in all figures.

The supporting device 10 of this invention is made up of a pair of matching collar plates 12 and 14. Each of the collar plates 12 and 14 has a flange 16 projecting up from their respective inner edges 18.

Figure 4:
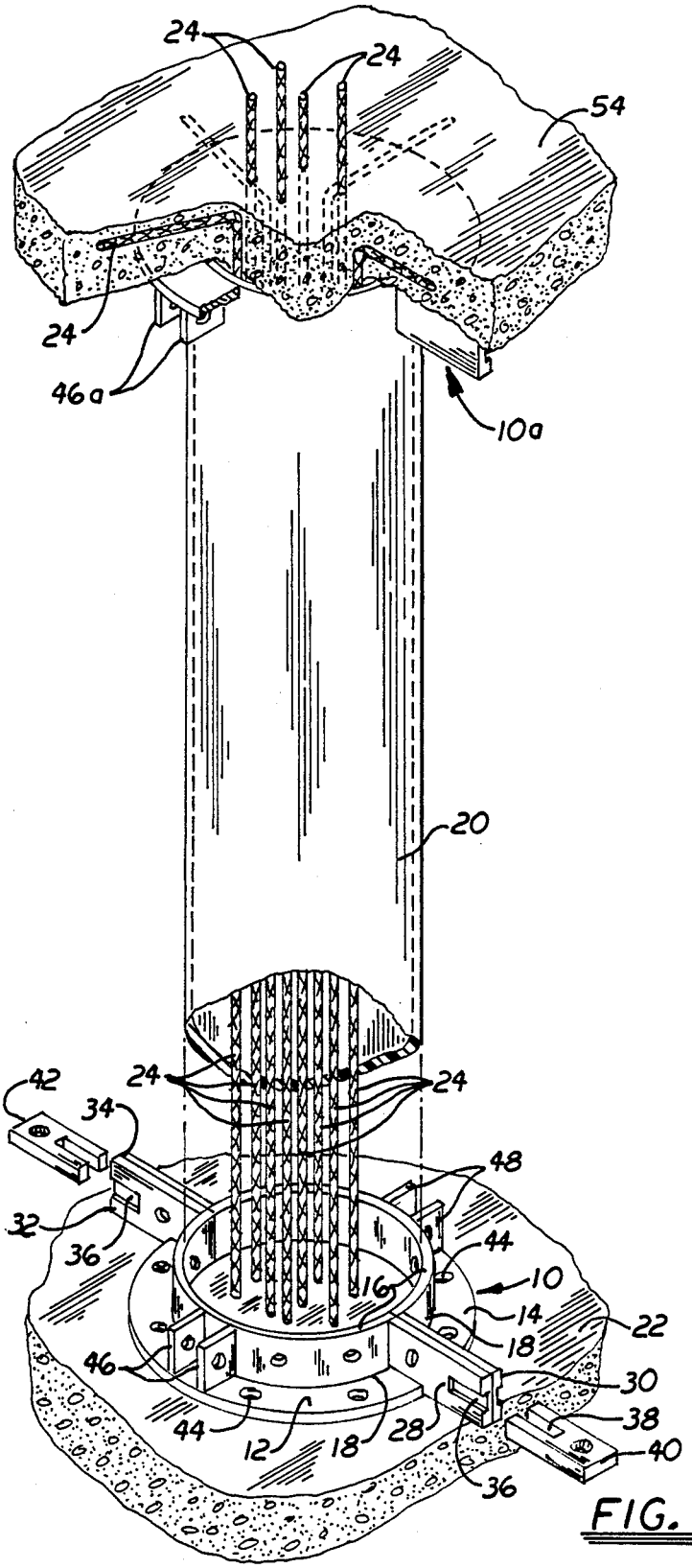
FIG. 4 is a perspective view of the supporting device of the invention surrounding a partially cut away column form with second level concrete floor in place.

The plates and flange are each semi-circular in shape so that when matched together a pair of plates form a circle exactly matching the outer circumference of a concrete form 20. The form 20 is set in place over concrete reinforcing bars 24 set in concrete pad 22. A second supporting device **10*a* is held in place by a wood brace 26 at the top of the column form 20 prior to pouring the second floor. See FIG. 1. When the second or higher floor 54 has been poured there is no need for the wood bracing. See FIG. 4**.

The plates 12 and 14 are held together by locking fixtures 28, 30, 32 and 34. These locking fixtures are integral with the ends of each flange 16 and are approximately at right angles to the plates 12 and 14 respectively. Each one of the locking fixtures has a groove 36 engaged by a slot 38 on a locking key 40 to hold the respective locking fixtures together. In this manner 28 and 30 are held together by locking key 40 and locking fixtures 32 and 34 are held together by locking key 42.

Holes 44 in plate 12 and 14 enable the plates to be temporarily fastened with concrete nails to the concrete pad 22 to prevent movement.

A bracket 46 on plate 12 and bracket 48 on plate 14 provide a means for inserting a wood brace 26 so that the supporting device **10*a* can be held in plaoe when the upper floor has not been poured. The wood brace 26 is inserted at one end in bracket 46*a* on device 10*a* and is nailed to the pad 22 at its other end. Plates 12 and 14 can be hinged 50 to keep the two plates 12 and 14** together.

Concrete is poured into the form 20 from the overhead chute 52. After the concrete sets the keys 40 and 42 and the nails are removed so that plates 12 and 14 can be pulled apart to allow the column mold 20 to be removed from the set cement.

Clamping device 10 can be made out of steel, preferably galvanized or other non-corrodible metal or can be made from a high strength polymer or a reinforced aluminum.

Equivalent elements can be substituted for the components employed in this invention without departing from the scope and intent of the invention as can be seen by one having ordinary skill in the art.

Having thus described the invention, what is claimed and desired to be secured by Letters Patent is:

1. A supporting device in combination with an upright concrete column form having a base end and a top end integrally joined with a contiguous cylindrical wall, the supporting device being readily assemblable and disassemblable from the form comprising:

(a) a pair of matching planar collar plates having an inner and outer edge, each forming a semi-circle around one-half of the column form with the inner edge of each plate juxtaposed around the concrete column form, (b) a semi-circular flange projecting upwardly or downwardly from the inner edge of each plate and juxtaposed to the column form, (c) a locking fixture at right angles to the plate projecting outwardly from a first and second end of each semi-circular flange, (d) a plurality of fastener holes in the collar plates, (e) the supporting device circumscribing both the base end and top end of the column form., and (f) the pair of collar plates hinged together at an end of one locking fixture for each plate.

2. The supporting device according to claim 1 wherein each collar plate supports a bracket for receiving the end of a brace.

3. The supporting device according to claim 1 wherein the pair of collar plates are locked together by a slotted key engaging a groove at the end of each locking fixture which is not hinged from each plate.

4. The supporting device according to claim 1 wherein the plates at the bottom of the form are fastened to a concrete pad and the plates at the top of the column form are held in place by a wood brace.

5. Supporting devices in combination with a removable upright concrete column form having a base end and a top end integrally joined with a contiguous cylindrical wall, one supporting device circumscribing the base end and one circumscribing the top end of the column form and being readily assemblable and disassemblable from the form, each supporting device comprising:

(a) a pair of matching planar collar plates having a curved inner edge forming together a circle abutting and supporting the removable concrete form;

(b) a semi-circular flange integral with and projecting at a right angle from each plate, the flanges from the pair of matching planar collar plates forming together a circle abutting and supporting the removable concrete form;

(c) a pair of locking fixtures integral with each plate and flange, each fixture at right angles to the plate and projecting outwardly from a first and second end respectively of each semi-circular flange; and (d) a matching locking fixture from each plate held together by a holding element at the first end and a hinge at the second end of the locking fixture from each plate.

6. The supporting device according to claim 5 wherein the holding element is a slotted key engaging a groove at the end of at least one locking fixture from each plate.

* * * * *